US010514050B2

(12) United States Patent
Revenus

(10) Patent No.: US 10,514,050 B2
(45) Date of Patent: Dec. 24, 2019

(54) DOUBLE-ACTING HYDRAULIC CYLINDER

(71) Applicant: MAQUET GMBH, Rastatt (DE)

(72) Inventor: Rolf Revenus, Kuppenheim (DE)

(73) Assignee: MAQUET GMBH, Rastatt (DE)

( * ) Notice: Subject to any disclaimer, the term of this patent is extended or adjusted under 35 U.S.C. 154(b) by 89 days.

(21) Appl. No.: 15/871,795

(22) Filed: Jan. 15, 2018

(65) Prior Publication Data

US 2018/0156247 A1 Jun. 7, 2018

Related U.S. Application Data

(63) Continuation-in-part of application No. PCT/EP2016/066438, filed on Jul. 11, 2016.

(30) Foreign Application Priority Data

Jul. 14, 2015 (DE) ..... 10 2015 111 403

(51) Int. Cl.
*F15B 15/14* (2006.01)
*A61G 13/00* (2006.01)

(52) U.S. Cl.
CPC ..... *F15B 15/149* (2013.01); *A61G 13/00* (2013.01); *F15B 15/1438* (2013.01); *F15B 2211/7053* (2013.01)

(58) Field of Classification Search
CPC . F15B 15/149; F15B 15/1438; F15B 15/1428
(Continued)

(56) References Cited

U.S. PATENT DOCUMENTS 2,832,656 A * 4/1958 Perry ..... A61G 13/0018 5/614
4,060,221 A 11/1977 Rilbe
(Continued)

FOREIGN PATENT DOCUMENTS

CN 87211000 U 5/1988
CN 2460766 Y 11/2001
(Continued)

OTHER PUBLICATIONS

International Search Report and Written Opinion (with English translations) dated Oct. 11, 2016 which issued during corresponding International Patent Application No. PCT/EP2016/066438, 22 pages.
(Continued)

*Primary Examiner* — Thomas E Lazo
*Assistant Examiner* — Michael Quandt
(74) *Attorney, Agent, or Firm* — Aaron M. Miller

(57) ABSTRACT

A double-acting hydraulic cylinder has a first cylinder housing and a piston guided in the first cylinder housing, wherein a first pressure chamber and a second pressure chamber are provided in the first cylinder housing and are additionally separated from one another by the piston. A first connector serves to feed a hydraulic liquid to the first pressure chamber, and a second connector serves to feed the hydraulic liquid to the second pressure chamber. A second cylinder housing surrounds the first cylinder housing at least in one section. The first connector and the second connector may be arranged at an end of the double-acting hydraulic cylinder which faces away from the second pressure chamber. The second pressure chamber may be loaded with the hydraulic liquid via the section in which the second cylinder housing surrounds the first cylinder housing.

14 Claims, 11 Drawing Sheets

(58) Field of Classification Search
USPC ..... 92/119; 5/614
See application file for complete search history.

(56) References Cited

U.S. PATENT DOCUMENTS 5,117,741 A * 6/1992 Richards ..... F15B 15/149 114/286
6,280,268 B1 * 8/2001 Nishi ..... B63H 20/10 440/61 D

FOREIGN PATENT DOCUMENTS

| | | | |
|---|---|---|---|
| CN | 1439080 | A | 8/2003 |
| CN | 1526960 | A | 9/2004 |
| CN | 201050516 | Y | 4/2008 |
| CN | 101275595 | A | 10/2008 |
| DE | 29902773 | U1 | 5/1999 |
| DE | 102005061730 | A1 | 5/2006 |
| DE | 102007048907 | A1 | 4/2009 |
| DE | 102014110670 | A1 | 12/2015 |
| GB | 937765 | A | 9/1963 |
| GB | 1357968 | A | 6/1974 |
| JP | S62204003 | U | 12/1987 |
| JP | S63104704 | U | 7/1988 |
| JP | 2000-337313 | A | 12/2000 |
| WO | 91/10810 | A1 | 7/1991 |

OTHER PUBLICATIONS

Chinese Office Action and Chinese Search Report dated Apr. 19, 2019 during the prosecution of corresponding Chinese Patent Application No. 201680050556.9, 6 pages.

* cited by examiner

DOUBLE-ACTING HYDRAULIC CYLINDER

CROSS-REFERENCE TO RELATED APPLICATIONS

The present application is a continuation-in-part filed under 35 U.S.C. § 111(a), and claims the benefit under 35 U.S.C. § 365(c) of PCT International Application No. PCT/EP2016/066438, filed Jul. 11, 2016, which designates the European Patent Office, and claims the benefit of German Patent Application No. 10 2015 111 403.8, filed Jul. 14, 2015. The disclosure of each of these applications is incorporated by reference herein in their entirety.

TECHNICAL FIELD

The present disclosure relates to hydraulic cylinders, and more particularly relates to double-acting hydraulic cylinders.

BACKGROUND

Double-acting hydraulic cylinders are known from the prior art. FIG. 8A shows a sketch of a known double-acting hydraulic cylinder 100. The known hydraulic cylinder 100 according to FIG. 8A comprises a cylinder housing 102 and a piston 104 guided in the cylinder housing 102 and a second pressure chamber 108 formed by the cylinder housing 102. The first pressure chamber 106 and the second pressure chamber 108 are separated from one another by the piston 104. The first pressure chamber 106 is also designated as cylinder chamber A while the second pressure chamber 108 is also designated as cylinder chamber B.

As FIG. 8A shows, the cylinder chambers 106, A and 108, B must be connected to a supply unit/control unit 110 which supply the hydraulic cylinder 100 with a liquid or gaseous medium. The connection between the supply unit/control unit 100 and the connector 112 and 114 on the cylinder housing 102 takes place via a flexible hose 116, 118. Typically, an annular eyelet 120 consisting of metal, a hollow screw 122 and two seals 124, 126 are attached on the particular hose end, as is schematically shown in FIG. 8C. FIG. 8C shows in particular a schematic view of an exposed hollow screw 122 of the known hydraulic cylinder 100 according to FIG. 8A. For the usage in operating tables a hose 116, 118 with a nominal width D3 and DN 4 are typically used. Furthermore, the screwing has a height L1 from the outer surface of the cylinder housing 102 to the end of the hollow screw 122 of about 15 mm. The hoses 116, 118 are necessary if the cylinder 100 shown in FIG. 8A is movably attached.

FIG. 8B shows a schematic view of a double-acting hydraulic cylinder 200 according to the prior art. FIG. 8B shows in particular a replacement part image of the double-acting hydraulic cylinder 200 of the construction series CSH1 MF3, MF4, MT4 and MS2 according to the Bosch Rexroth catalog with the catalog number RD17332/07.13. In double-acting hydraulic cylinders a connector for a liquid medium must be provided on the A side, i.e., the piston side, and on the B side, i.e., on the piston rod side. This is usually accomplished, as is shown in FIG. 8B, by a connector bore 212, 214 in the housing of the double-acting hydraulic cylinder 200.

The known, double-acting hydraulic cylinders have the disadvantage that to the extent that the cylinder 102 shown in FIG. 8A is used with the hose connectors 112, 114 in close structural spaces, the hollow screw 122 shown in FIG. 8C is very exposed and problematic. This is especially disadvantageous in that about 15 mm structural space in the length or the width of the hydraulic cylinder are lost. Furthermore, the known, double-acting hydraulic cylinders have the disadvantage that the exposed hollow screw 122 can be readily sheared off on close structural components during the hydraulic cylinders movement due to the high cylinder forces during the traveling movement. In addition, the hose connections 116, 118 shown in FIG. 8A in the known, double-acting hydraulic cylinders are relatively susceptible to being damaged.

SUMMARY OF THE DISCLOSURE

Embodiments of the present disclosure pertain to a double-acting hydraulic cylinder which may have for example a compact and robust construction and at the same time makes possible its reliable operation.

Such advantages may be achieved through employing aspects of the disclosed embodiments. This type of problem may for example be solved by a double-acting hydraulic cylinder with the features of one or more of the independent claim(s). Advantageous further developments are indicated the dependent claims.

A compact and robust construction of the double-acting hydraulic cylinder and at the same time its reliable operation may be achieved by a double-acting hydraulic cylinder according to the exemplary embodiments disclosed herein. In particular a first cylinder housing, a piston guided in the first cylinder housing and a second cylinder housing may be provided or otherwise employed in such embodiments. A first pressure chamber and a second pressure chamber are provided in the first cylinder housing which are separated from one another by the piston. A first connector serves at least to feed a hydraulic liquid to the first pressure chamber while the second connector serves at least to feed the hydraulic liquid to the second pressure chamber. The second cylinder housing surrounds the first cylinder housing at least in one section. The first connector and the second connector are arranged on an end of the double-acting hydraulic cylinder facing away from the second pressure chamber. The second pressure chamber can be loaded with the hydraulic liquid via the section in which the second cylinder housing surrounds the first cylinder housing. Therefore, the connector on the B side of the double-acting hydraulic cylinder can be eliminated. Instead, this connector can be provided on the A side of the double-acting hydraulic cylinder. The A side is located on a first side of the piston here while the B side is located on a second side of the piston opposite the first side.

This can avoid a relatively large structural space for the double-acting hydraulic cylinder. Furthermore, a shearing off of an exposed connector element such as, e.g., an exposed hollow screw can be avoided. Moreover, it can be prevented that during the operation of the double-acting hydraulic cylinder damage to the connection hoses extending between the connectors of the double-acting hydraulic cylinder and the supply/control unit (such as, e.g., a hydraulic unit) occur. This makes possible the compact and robust construction of the double-acting hydraulic cylinder and at the same time its reliable operation.

The second cylinder housing according to an example embodiment surrounds the first cylinder housing at least in a section along the longitudinal axis of the double-acting hydraulic cylinder. Therefore, a section in which the second cylinder housing surrounds the first cylinder housing can be made available, wherein this section extends along the longitudinal axis of the double-acting hydraulic cylinder.

The first pressure chamber is according to an example embodiment a piston-side pressure chamber while the second pressure chamber is a pressure chamber on the piston rod side. Therefore, a piston-side pressure chamber and a pressure chamber of a differential cylinder on the piston rod side can be made available which are formed by the first cylinder housing.

The end of the double-acting hydraulic cylinder facing away from the second pressure chamber is according to an example embodiment limited by a cylinder bottom. The cylinder bottom can surround an end of the first cylinder housing facing away from the second pressure chamber and an end of the second cylinder housing facing away from the second pressure chamber. Therefore, the piston-side ends of the first and of the second cylinder housing facing away from the second pressure chamber are firmly connected to the cylinder bottom.

A first sealing element is according to an example embodiment arranged between the end of the first cylinder housing facing away from the second pressure chamber and between the cylinder bottom. Furthermore, a second sealing element is arranged between the end of the second cylinder housing facing away from the second pressure chamber and between the cylinder bottom. Therefore, a first and a second sealing element can be made available with the aid of which the end of the first cylinder housing facing away from the second pressure chamber and the end of the second cylinder housing facing away from the second pressure chamber and the cylinder bottom can be sealed against each other.

The first connector and the second connector are according to an example embodiment arranged on the cylinder bottom. Therefore, the first connector as well as the second connector can be provided on an end of the double-acting hydraulic cylinder facing away from the second pressure chamber.

The first connector according to an example embodiment comprises a first through opening. The first through opening extends from a lateral surface of the cylinder bottom to the first pressure chamber. Therefore, a first through opening can be made available in the cylinder bottom via which the first pressure chamber can be loaded with the hydraulic liquid.

The second connector according to an example embodiment comprises a second through opening. The second through opening extends from a lateral surface of the cylinder bottom to the section in which the second cylinder housing surrounds the first cylinder housing. Therefore, a second through opening can be made available in the cylinder bottom via which the second pressure chamber can be loaded with the hydraulic liquid.

The first cylinder housing and the second cylinder housing are according to an example embodiment arranged in such a manner that an intermediate space is formed between the first cylinder housing and the second cylinder housing. The intermediate space extends from the end of the double-acting hydraulic cylinder facing away from the second pressure chamber to an end of the double-acting hydraulic cylinder facing away from the first pressure chamber. Therefore, an intermediate space can be made available between the first and the second cylinder housing, wherein this intermediate space serves to produce a connection of the second pressure chamber to the second connector of the end of the double-acting hydraulic cylinder facing away from the second pressure chamber.

The double-acting hydraulic cylinder according to an example embodiment comprises a rod sleeve. The rod sleeve is arranged on an end of the first and second cylinder housing facing away from the first pressure chamber. Also, the rod sleeve is constructed in such a manner that a piston rod connected to the piston moves upon a loading of the first pressure chamber with the hydraulic liquid in a first direction of piston movement and upon a loading of the second pressure chamber with the hydraulic liquid in a second direction of piston movement opposite to the first direction of piston movement. Therefore, a rod sleeve can be provided on the piston-rod-end of the double-acting hydraulic cylinder which closes an end of the hydraulic cylinder facing away from the first pressure chamber.

The rod sleeve according to an example embodiment comprises a recess. Furthermore, the second pressure chamber can be loaded with the hydraulic liquid via the section in which the second cylinder housing surrounds the first cylinder housing and via the recess of the rod sleeve. Therefore, the piston-rod-side pressure chamber can be loaded in a simple and reliable manner with the hydraulic liquid with the aid of the second connector provided on the piston-side end of the double-acting hydraulic cylinder.

The first cylinder housing according to an example embodiment comprises a first cylinder tube and the second cylinder housing comprises a second cylinder tube. This can create in particular a simple and robust construction of the double-acting hydraulic cylinder.

The double-acting hydraulic cylinder according to an example embodiment comprises at least one holding element for holding the second cylinder housing. It can be noted that the least one first holding element is arranged at least in sections around the second cylinder housing on an outer surface of the second cylinder housing. In this manner, the first and the second cylinder housing can be held in a simple and reliable manner on the cylinder bottom with the aid of the at least one first holding element.

The first connector according to an example embodiment is constructed in such a manner that it can be connected to a first connection line at least for feeding the hydraulic liquid. Furthermore, the second connector is constructed in such a manner that that it can be connected to a second connection line at least for feeding the hydraulic liquid. Therefore, two suitable connectors can be made available for connecting to a hydraulic unit.

The double-acting hydraulic cylinder can be in particular a differential cylinder, synchronizing cylinder or a tandem cylinder.

Other features and advantages of the embodiments of the present disclosure result from the following description which explains aspects of the invention in detail using exemplary embodiments in conjunction with the attached figures.

DETAILED DESCRIPTION

For illustrative purposes, the principles of the embodiments of the present disclosure are described by referencing various exemplary embodiments. Although certain embodiments are specifically described herein, one of ordinary skill in the art will readily recognize that the same principles are equally applicable to, and can be employed in other systems and methods. Before explaining the disclosed embodiments of the present disclosure in detail, it is to be understood that the inventions are not limited in their application to the details of any particular embodiment shown. Additionally, the terminology used herein is for the purpose of description and not of limitation. It must be noted that as used herein and in the appended claims, the singular forms "a", "an", and "the" include plural references unless the context clearly dictates otherwise. As well, the terms "a" (or "an"), "one or more" and "at least one" can be used interchangeably herein. It is also to be noted that the terms "comprising," "including," "composed of," and "having" can be used interchangeably.

Figure 1A:
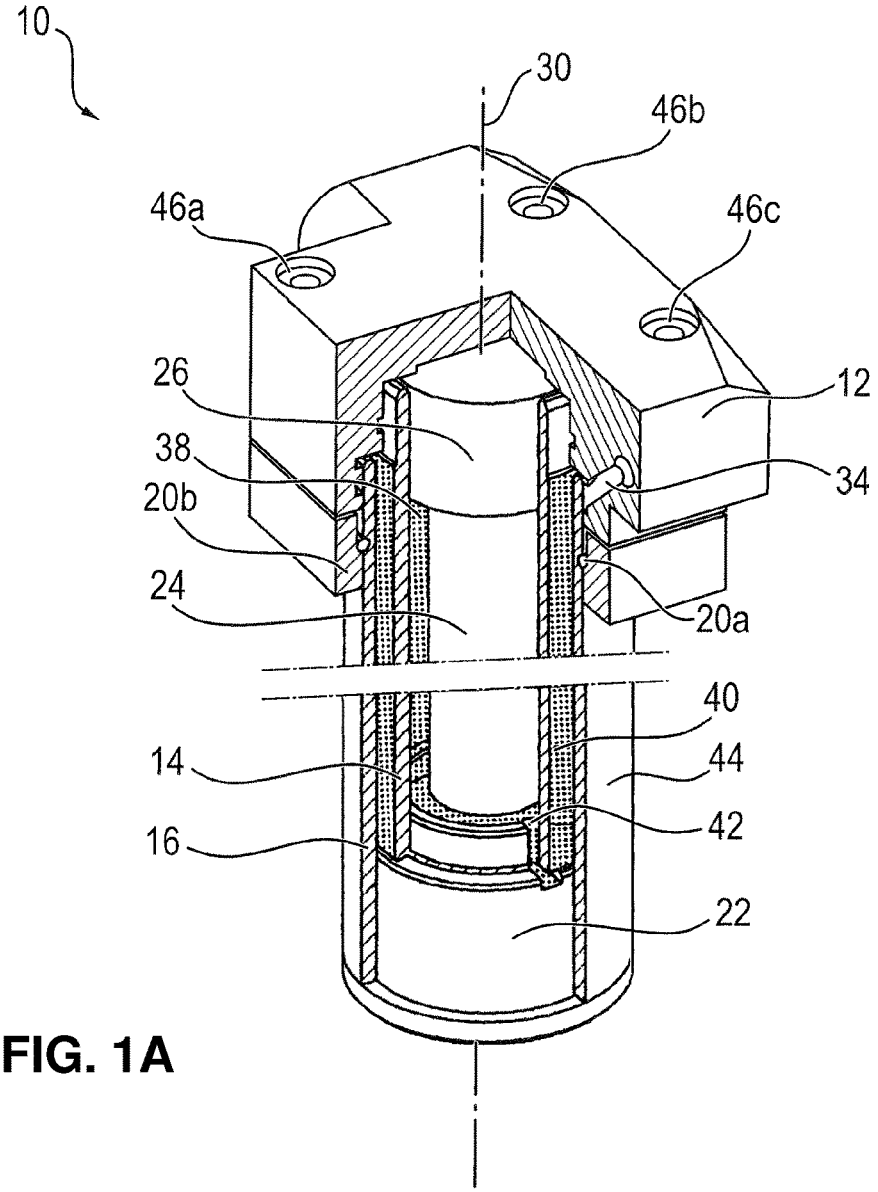
FIG. 1A shows a schematic, perspective view of a double-acting hydraulic cylinder according to an exemplary embodiment.

FIG. 1A shows a schematic, perspective view of a double-acting hydraulic cylinder 10 according to an exemplary embodiment. FIG. 1A shows in particular a double-wall cylinder in a sectional view. As FIG. 1A shows, the double-acting hydraulic cylinder 10 comprises a first cylinder tube 14, a second cylinder tube 16 and a piston 26. The piston 26 is connected to a piston rod 24. The longitudinal axis 30 of the double-acting hydraulic cylinder 10 extends through a middle point of the piston rod 24 along a longitudinal extension of the piston rod 24. The first and the second cylinder tubes 14, 16 are concentrically arranged around this longitudinal axis 30 of the double-acting hydraulic cylinder 10.

In the exemplary embodiment shown in FIG. 1A, the first cylinder tube 14 is provided, on which the piston 26 slides in a sealed manner and produces the power of the actuator. Furthermore, the second cylinder tube 16 is arranged around this first cylinder tube 14. A first piston-rod-side end of the second cylinder tube 16 is tightly connected to a rod sleeve 22. A second end of the cylinder tube 16 opposite the first end is tightly connected to a cylinder bottom 12. The first cylinder tube 14 serves as the inner cylinder tube whereas the second cylinder tube 16 serves as the outer cylinder tube. The second cylinder tube 16 is held on the cylinder bottom 12 via a wire ring 20*a* and an annular holding element 20*b* with the aid of screws 46A to 46D. The second cylinder tube 16 is sealed against this section. The screw 46D is not shown in the sectional view according to FIG. 1A.

According to FIG. 1A, the double-acting hydraulic cylinder 10 surrounds a connector 34 for loading a piston-rod-side pressure chamber 38 with a hydraulic liquid. As FIG. 1A shows, this connector 34 is provided in the cylinder bottom 12. The connector 34 arranged in the cylinder bottom 12 is preferably connected via bores to the intermediate space 40 between the first and the second cylinder tubes 14, 16. Furthermore, the closure 22 arranged on the piston-rod-side end of the double-acting hydraulic cylinder 10 and with an opening for the piston rod comprises a groove 42. This closure can also be designated as a rod sleeve. In the exemplary embodiment shown in FIG. 1A, the hydraulic liquid is introduced into the pressure chamber 38 on the piston rod side via the screw 42 in the rod sleeve 22. Therefore, the pressure chamber 38 on the piston rod side, i.e., the B side of the double-acting hydraulic cylinder 10 can be loaded with the hydraulic liquid volume of the connector 34 arranged in the cylinder bottom 12 or hydraulic liquid can be discharged from the pressure chamber 38. Furthermore, the double-acting hydraulic cylinder 10 shown in FIG. 1A comprises a connector 32 for loading the piston-side pressure chamber 36 with the hydraulic liquid as well as for discharging hydraulic liquid from this pressure chamber. This connector 32 and the piston-side pressure chamber 36 are not shown in FIG. 1A. For the inclusion into a cylindrical bore the jacket diameter formed by the second cylinder tube 16 is the relevant magnitude.

Figure 1B:
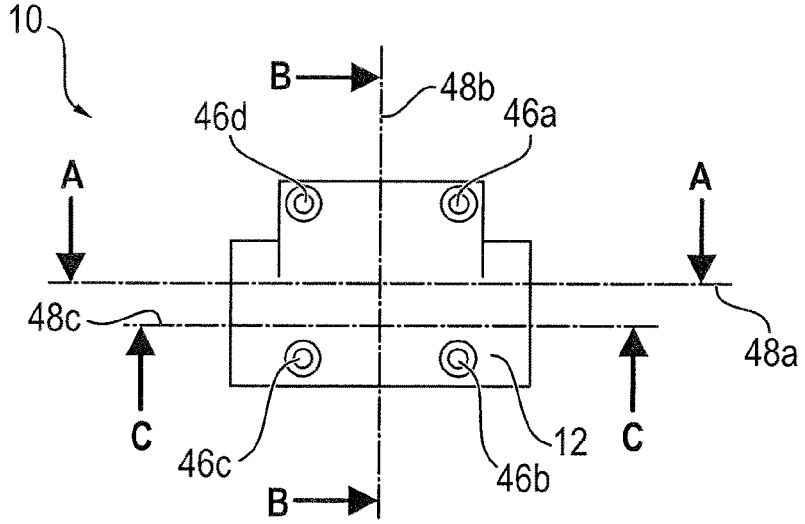
FIG. 1B shows a schematic top view onto the double-acting hydraulic cylinder according to FIG. 1A.
Figure 3:
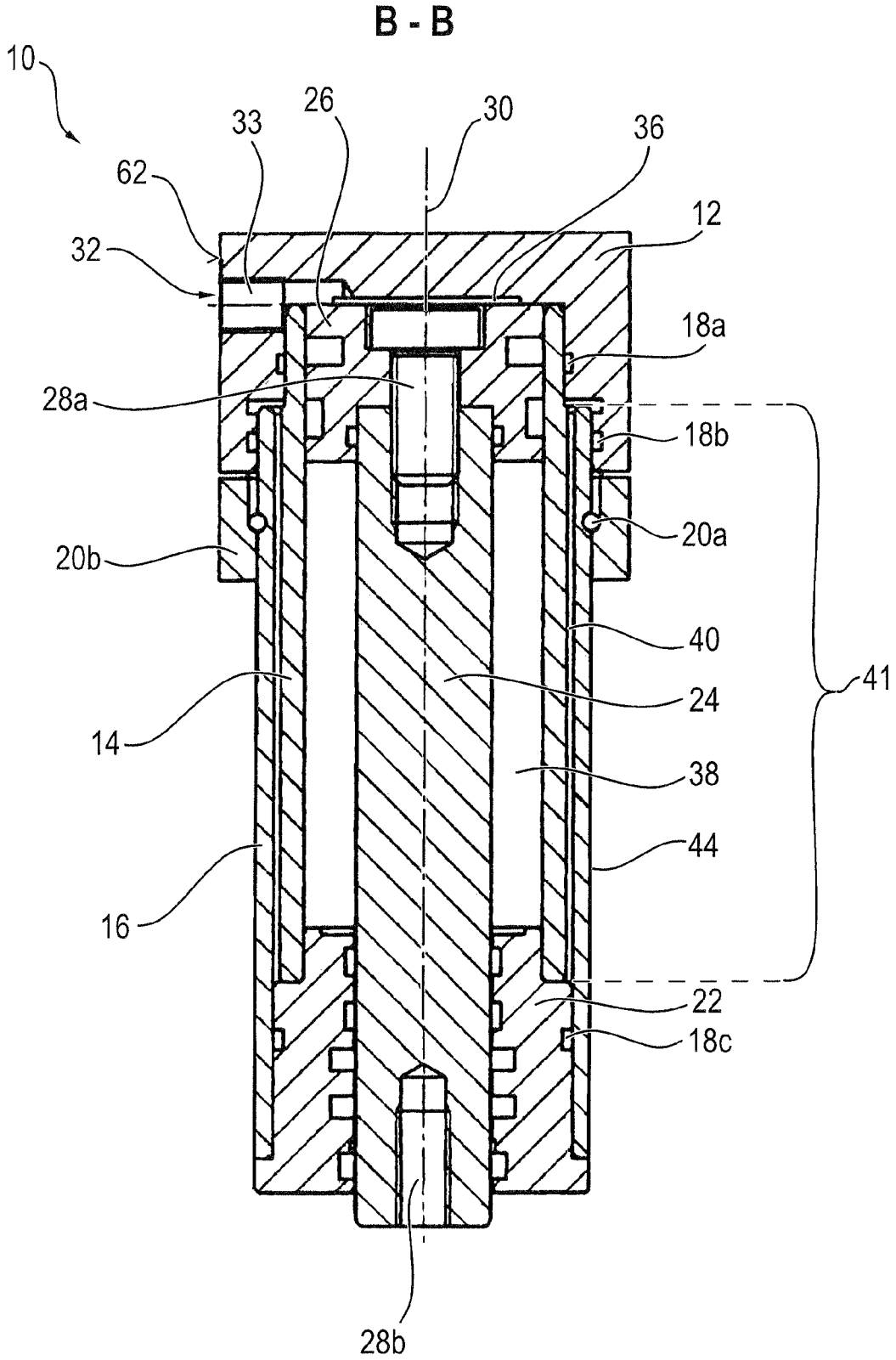
FIG. 3 shows a schematic view in longitudinal section along the section line B-B in FIG. 1B.
Figure 4A:
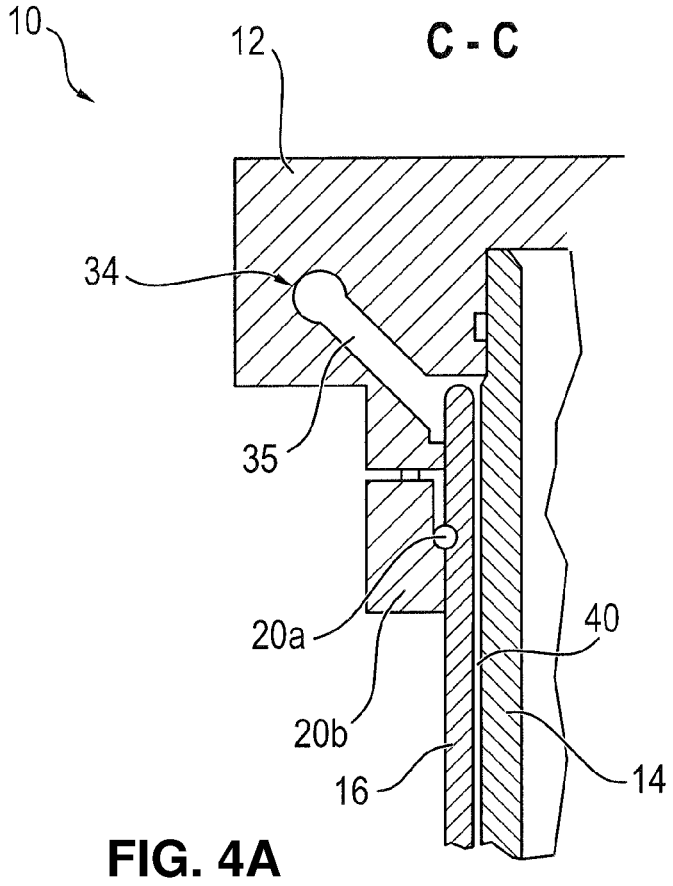
FIG. 4A shows a schematic view in longitudinal section along the section line C-C in FIG. 1*b;*

FIG. 1*b* shows a schematic top view onto the double-acting hydraulic cylinder 10 according to FIG. 1A. In FIG. 1*b*, the cylinder bottom 12 in particular is schematically shown with the screws 46A to 46D extending through the cylinder bottom 12. FIG. 1*b* serves to illustrate a first to a third section line 48A, A-A, 48B, B-B, and 48C, C-C relative to the cylinder bottom 12. The following FIGS. 2, 3 and 4A are sectional views of sections along the first to the third section lines 48A to 48C shown in FIG. 1*b*.

Figure 2:
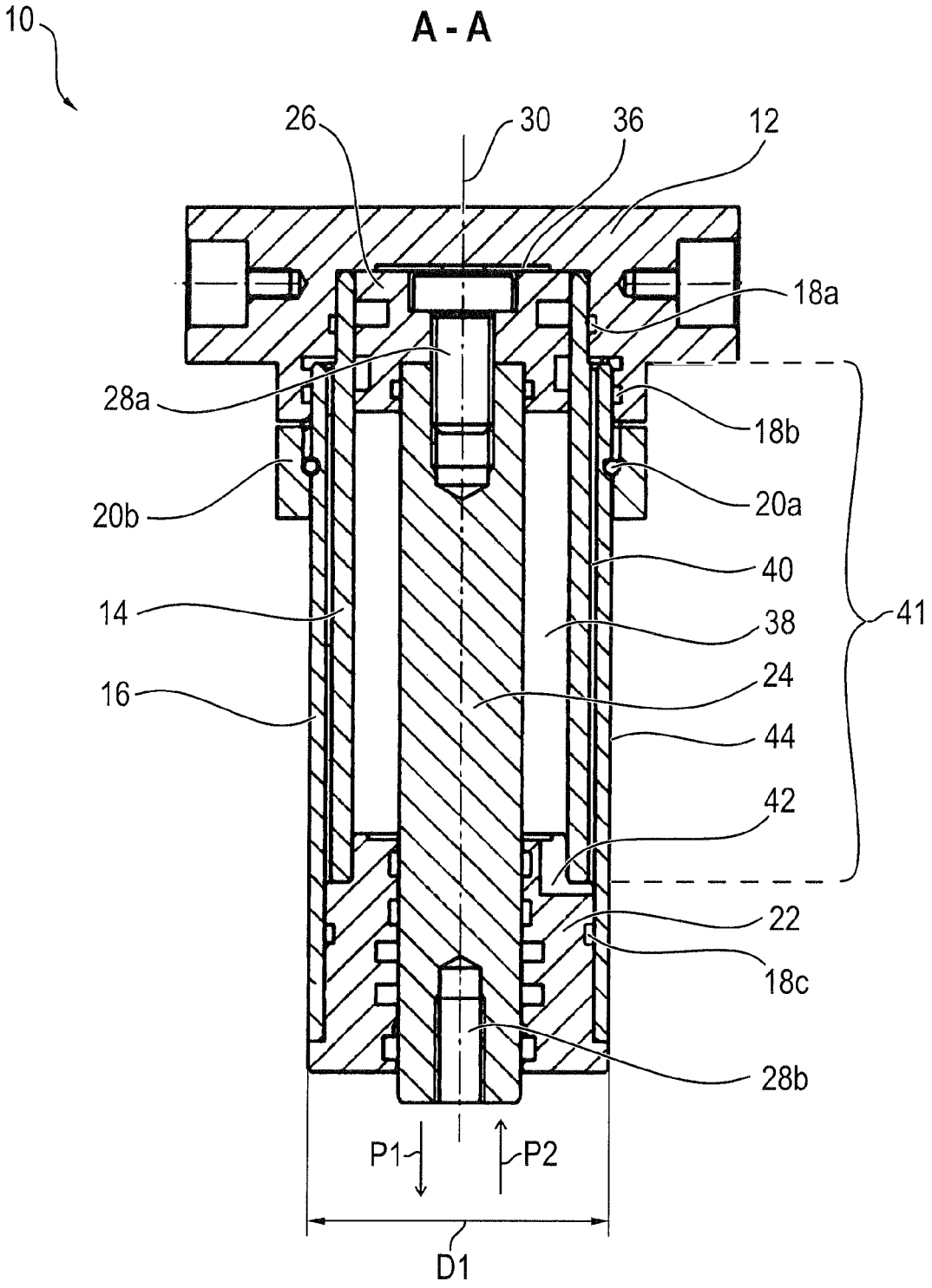
FIG. 2 shows a schematic view in longitudinal section along the section line A-A in FIG. 1*b;*

FIG. 2 shows a schematic sectional view of a longitudinal section along the section line 48A, A-A in FIG. 1*b*. In the schematic sectional view according to FIG. 2, substantially the elements 12 to 44 of the double-acting hydraulic cylinder 10 according to FIG. 1 are readily visible. The connector 34 shown in FIG. 1A for loading and removing the hydraulic liquid to and from the piston-rod-side pressure chamber 38 is not visible in FIG. 2. According to FIG. 2, the double-acting hydraulic cylinder 10 comprises the first cylinder tube 14 and the piston 26 guided in the first cylinder tube 14. The first cylinder tube 14 preferably comprises the piston-side pressure chamber 36 formed by the first cylinder tube 14 between the piston 26 and the first end of the cylinder tube 14 closed by the cylinder bottom 12, which end is opposite the piston rod 24, and comprises the piston-rod-side pressure chamber 38 formed by the first cylinder tube 14 between the piston 26 and the second end of the cylinder tube 14 closed by the rod sleeve 22. The piston-side pressure chamber 36 and the pressure chamber 38 on the piston rod side are separated from each other by the second piston 26. The second end of the first cylindrical tube 14, of which the end is closed with the aid of the rod sleeve 22, is also designated as an end on the piston rod side and the second end of the cylindrical tube 14 closed with the aid of the cylinder bottom 12 is also designated as the piston-side end.

As FIG. 2 shows, a first sealing element 18A is arranged between the piston-side end of the first cylinder tube 14 and the cylinder bottom 12. Furthermore, a second sealing element 18B is arranged between the piston-side end of the second cylinder tube 16 and the cylinder bottom 12. In addition, a third sealing element 18C can be provided which is arranged between the piston-rod-side end of the second cylinder tube 16 and the rod sleeve 22. The first to the third sealing element 18A to 18C preferably comprise a static sealing element such as, e.g., an O-ring. In this manner, in particular the second cylinder tube 16 can be reliably sealed on its piston-side end and its piston-rod-side end against the cylinder bottom 12 and the rod sleeve 22.

Furthermore, FIG. 2 shows that the double-acting hydraulic cylinder 10 comprises a first and a second screw connection 28A, 28B. The first screw connection 28A serves to connect the piston 26 to the piston rod 24 whereas the second screw connection 28B serves to connect a piston-rod-slide unit to the piston rod 24. The first and the second screw connections 28A, 8B preferably have a threading which is arranged on the piston-side or piston-rod-side end of the piston rod 24. The piston sleeve 22 serves to receive the piston rod 24. Furthermore, the rod sleeve 22 serves for the linear guiding of the piston rod 24 and of the piston 26 connected to the piston rod 24. As FIG. 2 schematically shows, the piston rod 24 and the piston 26 are linearly shifted upon a loading of the piston-side pressure chamber 36 with the hydraulic liquid into a first direction of piston movement P1. Furthermore, the piston rod 24 and the piston 26 are linearly shifted upon a loading of the piston-rod side pressure chamber 28 with the hydraulic liquid into a second direction of piston movement P2. The first and the second directions of piston movement P1, P2 are preferably substantially parallel to the longitudinal axis 30 of the double-acting hydraulic cylinder 10. Furthermore, the first and the second directions of piston movement P1, P2 are opposite piston movement directions of the double-acting hydraulic cylinder 10.

FIG. 2 shows in particular that the second cylinder tube 16 surrounds the first cylinder tube 14 at least in one section 41. According to FIG. 2, this section 41 extends along the longitudinal axis 30 of the double-acting hydraulic cylinder 10. The intermediate space 40 formed by the first and the second cylinder tubes 14, 16 extends substantially inside this section 41. Also, the intermediate space 40 extends substantially from the cylinder bottom 12 to the groove 42 provided in the rod sleeve 22. The groove 42 corresponds in particular to a recess of the rod sleeve 22 which extends from the intermediate space 40 to the pressure chamber 38 on the piston rod side. Therefore, the intermediate space 40, the recess 42 of the rod sleeve 22 and the piston-rod-side pressure chamber 38 are connected to each other. The dimension D1 shown in FIG. 2 is given by an outer surface 44 of the second cylinder tube 16. This dimension D1 corresponds to a built-in space for the double-acting hydraulic cylinder 10.

FIG. 3 shows a schematic longitudinal section along the section line 48B, B-B in FIG. 1*b*. In particular, the first connector 32 for loading the piston-side pressure chamber 36 is clearly visible in FIG. 3. As FIG. 3 schematically shows, the first connection 32 comprises a first through opening 33. This first through opening 33 preferably extends from a lateral surface 62 of the cylinder bottom 12 to the piston-side pressure chamber 36. For example, the first through opening 33 extends substantially vertically to the lateral surface 62 of the cylinder bottom 12. The first connector 32 serves to connect a first connection line 52. This first connection line 52 is not shown in FIG. 3.

FIG. 4A shows a schematic longitudinal section along the section line 48C, C-C in FIG. 1*b*. In particular, the second connector 34 for loading the piston-rod-side pressure chamber 38 can be well seen in FIG. 4A. As FIG. 4A schematically shows, the second connector 34 comprises a second through opening 35. This second through opening 35 preferably extends from a lateral surface 62 of the cylinder bottom 12 to the intermediate space 40 formed by the first and the second cylinder tubes 14, 16. For example, the second through opening 35 extends from the intermediate space 40 obliquely upward. The second connector 34 serves to connect a second connection line 54. This second connection line 54 is not shown in FIG. 4A. According to FIGS. 1A to 4A, the second connector 34, the intermediate space 40, the recess 42 of the rod sleeve 22 and the pressure chamber 38 on the piston rod side are connected to each other.

Figure 4B:
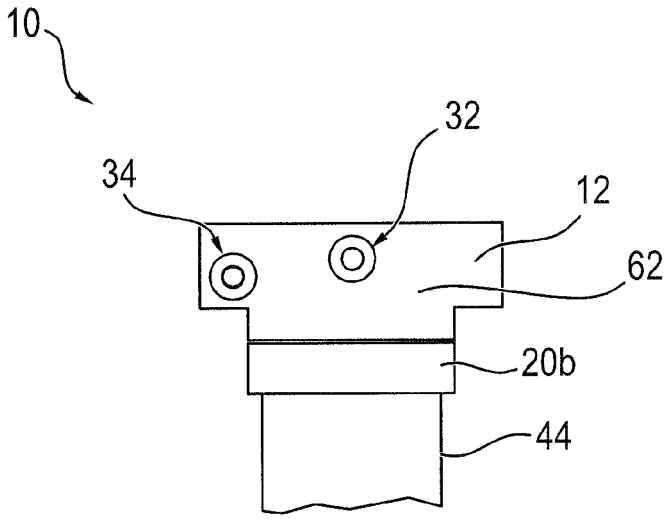
FIG. 4B shows a schematic view of a piston-side end of the double-acting hydraulic cylinder shown in FIG. 1A.

FIG. 4B shows a schematic view of a piston-side end of the double-acting hydraulic cylinder 10 shown in FIG. 1A. In particular, the first and the second connectors 32, 34 can be well seen in FIG. 4B. As FIG. 4B shows, the first connector 32 extending through the cylinder bottom 12 is arranged, for example, in a middle area of the double-acting hydraulic cylinder 10 whereas the second connector extending through the cylinder bottom 12 is arranged, for example, in a lateral area of the double-acting hydraulic cylinder 10. According to FIG. 4B, the first connector 32 as well as the second connector 34 can be provided on the piston-side end of the double-acting hydraulic cylinder 10.

Figure 5:
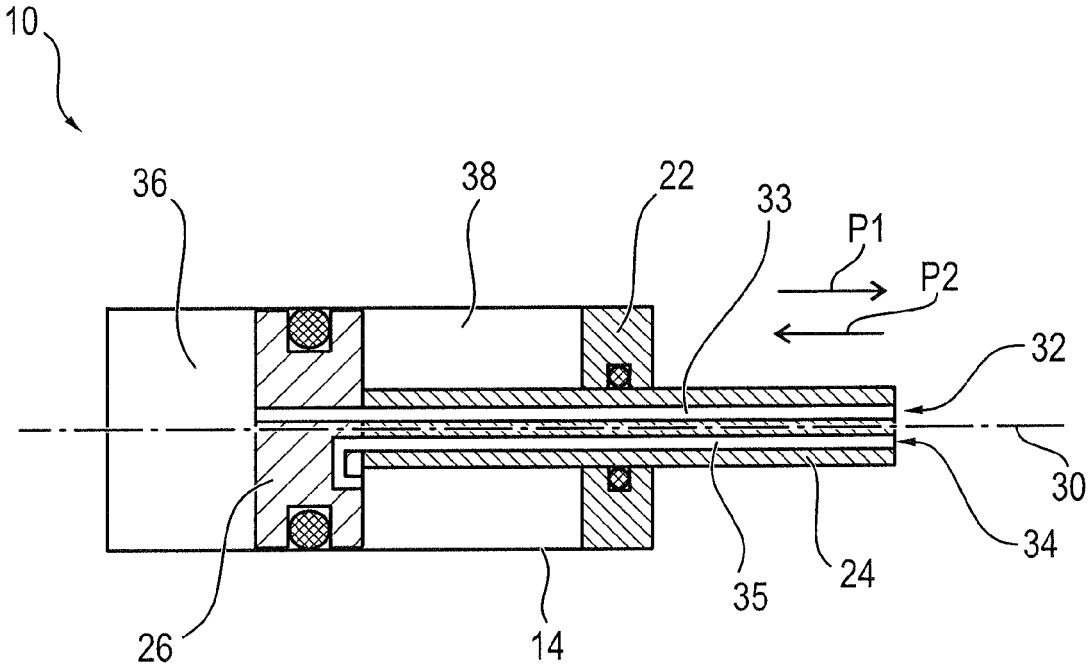
FIG. 5 shows an exemplary basic sketch of a double-acting hydraulic cylinder according to an exemplary embodiment.

FIG. 5 shows an exemplary basic sketch of a double-acting hydraulic cylinder 10 according to an exemplary embodiment. In the exemplary embodiment of FIG. 5, the double-acting hydraulic cylinder 10 comprises only a single cylinder tube 14. In particular, the double-acting hydraulic cylinder 10 according to the exemplary embodiment of FIG. 5 does not comprise the second cylinder tube 16 of the double-acting hydraulic cylinder 10 according to the exemplary embodiment of FIG. 1A. Therefore, the exemplary embodiment of FIG. 5 refers to another aspect of the present invention. The double-acting hydraulic cylinder 10 shown in FIG. 5 comprises the piston 26 guided in the cylinder tube 14 and which separates the piston-side pressure chamber 36 from the pressure chamber 38 on the piston-rod side. The piston-side and the piston-rod-side pressure chambers 36, 38 are formed by the cylinder tube 14. Furthermore, a piston-rod-side rod sleeve 22 is provided which receives and linearly guides the piston rod 24.

In the exemplary embodiment shown in FIG. 5, the double-acting hydraulic cylinder 10 comprises the first and the second connectors 32, 34. According to FIG. 5, the first connector 32 serves to load the piston-side pressure chamber 36 with a hydraulic liquid whereas the second connector 34 serves to load the piston-rod-side pressure chamber 38 with the hydraulic liquid. Furthermore, according to FIG. 5, the first connector 32 comprises a first through opening 33 whereas the second connector 34 comprises a second through opening 35. These first and second through openings 33, 35 preferably extend completely through the piston rod 24. The first and the second through openings 33, 35 extend substantially parallel to the longitudinal axis 30 of the double-acting hydraulic cylinder 10. According to FIG. 5, the first through opening 33 extends from an end of the piston rod facing away from the piston 26 through the piston rod 24 to an end of the piston rod 24 facing the piston 26. Furthermore, according to FIG. 5, the second through opening 35 extends from the end of the piston rod 24 facing away from the piston 26 through the piston rod 24 to the end of the piston rod 24 facing the piston 26. As FIG. 5 shows, the first through opening 33 furthermore extends from the end of the piston rod 24 facing the piston 26 parallel to the longitudinal axis 30 of the double-acting hydraulic cylinder 10 and completely through the piston 26 to the piston-side pressure chamber 36. FIG. 5 also shows that the second through opening 35 extends in a bent manner from the end of the piston rod 24 facing the piston 26 and partially through the piston 26 to the pressure chamber 38 on the piston-rod side. Therefore, according to the exemplary embodiment of FIG. 5 the piston-side and the piston-rod-side pressure chambers 36, 38 can be loaded with the hydraulic liquid via the first and the second connectors 32, 34 provided in the piston rod 24.

A few advantages of the present invention over the known prior art are explained using the following FIGS. 6A, 6B, 7A and 7B.

Figure 6A:
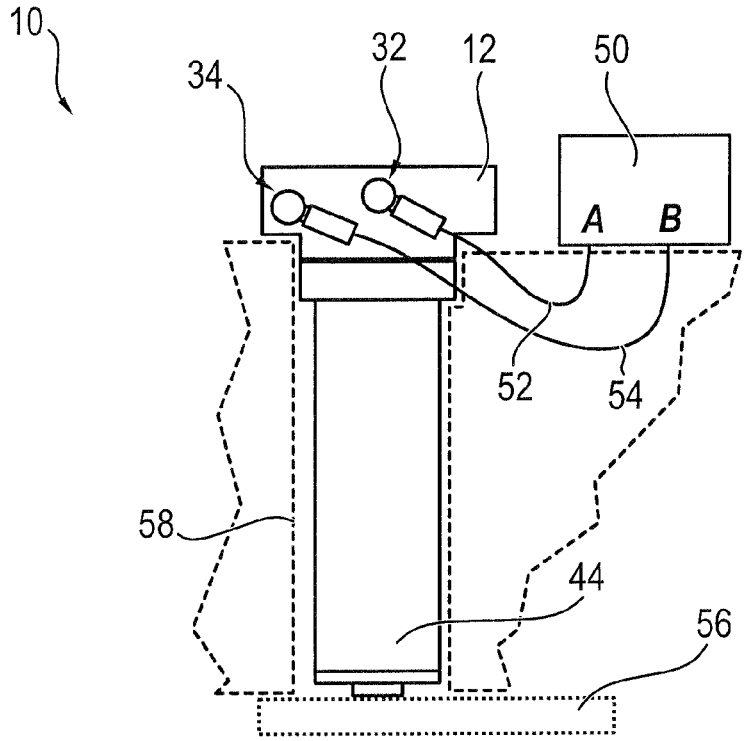
FIG. 6A shows a schematic view of a double-acting hydraulic cylinder with a first connector and a second connector according to an exemplary embodiment.

FIG. 6A shows a schematic view of a double-acting hydraulic cylinder 10 with a first connector 32 and a second connector 34 according to an exemplary embodiment. As FIG. 6A shows, the first and the second connectors 32, 34 are arranged on the cylinder bottom 12 of the double-acting hydraulic cylinder 10. Also, FIG. 6A shows that the first and the second connectors 32, 34 are connected to a hydraulic unit 50. The first connector 32 is preferably connected via a first connection line 52 to an A connector of the hydraulic unit 50 whereas the second connector 34 is connected via a second connection line 54 to a B connector of the hydraulic unit 50. The A connector of the hydraulic unit 50 serves to supply the first connector 32 with a hydraulic liquid whereas the B connector or of the hydraulic unit 50 serves to supply the second connector 34 with the hydraulic liquid.

In the exemplary embodiment shown in FIG. 6A, the piston-rod-side end of the double-acting hydraulic cylinder 10 is connected to a unit 56 on the piston-rod side. The piston-rod-side unit 56 can be shifted with the aid of the double-acting hydraulic cylinder 10 into the first and the second direction of piston movement P1, P2. FIG. 6A shows in particular the built-in space 58 for the double-acting hydraulic cylinder 10. The built-in space 58 is schematically shown in FIG. 6A by dotted lines. In the exemplary embodiment shown in FIG. 6A, the built-in space 58 is set substantially by the outer surface 44 of the second cylinder tube 16. Therefore, the built-in space 58 corresponds substantially to the dimension D1 shown in FIG. 2. In particular, the built-in space 58 for the double-acting hydraulic cylinder 10 according to the exemplary embodiment of FIG. 6A is relatively small in comparison to the prior art.

Figure 6B:
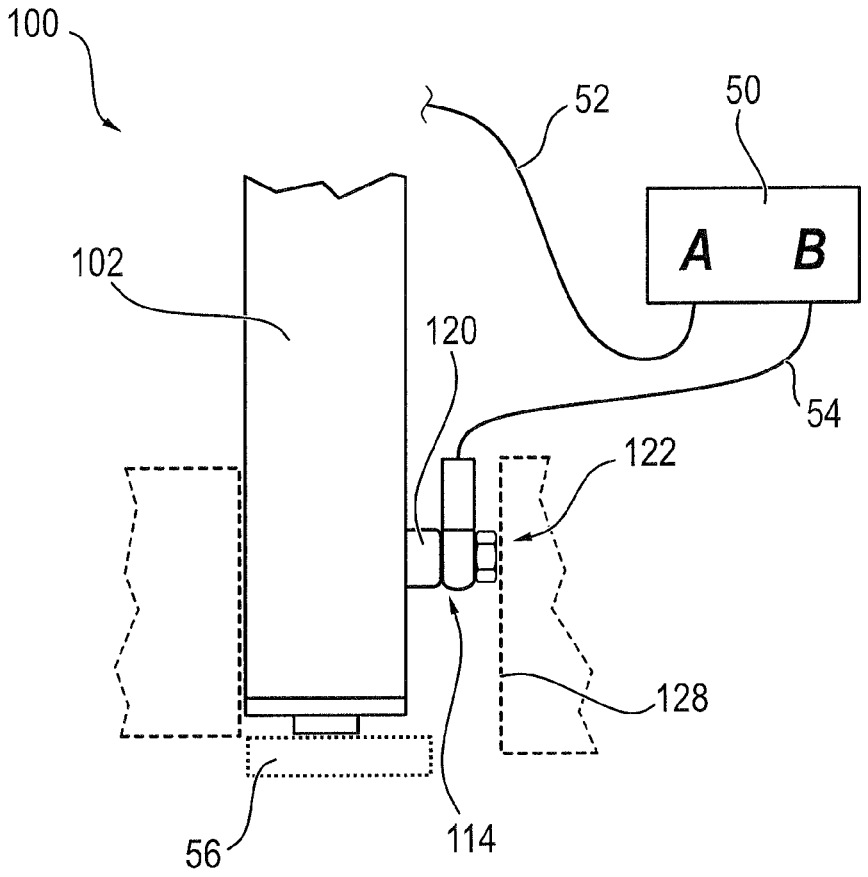
FIG. 6B shows a schematic view of a double-acting hydraulic cylinder with a connector on the B side of the double-acting hydraulic cylinder according to the prior art.

FIG. 6B shows a schematic view of a double-acting hydraulic cylinder 100 with a connector 114 on the B side of the adhesive 100. FIG. 6B shows in particular the connector 114 arranged on the piston-rod-side end of the double-acting hydraulic cylinder 100. The other connector 112 arranged on the piston-side end of the double-acting hydraulic cylinder 100 is not shown in FIG. 6B. These connectors 112, 114 are connected via two connection lines 52, 54 to the A connector and the B connector of a hydraulic unit 50. The built-in space 128 for the double-acting hydraulic cylinder 100 according to FIG. 6B is schematically shown in dotted lines. In particular, the built-in space 128 is substantially set by the lateral extension of the surface of the cylinder tube 102 and of the exposed hollow screw 122. Therefore, the built-in space 128 according to the prior art is relatively large in comparison to the built-in space 58 according to the exemplary embodiment of FIG. 6A.

Figure 7A:
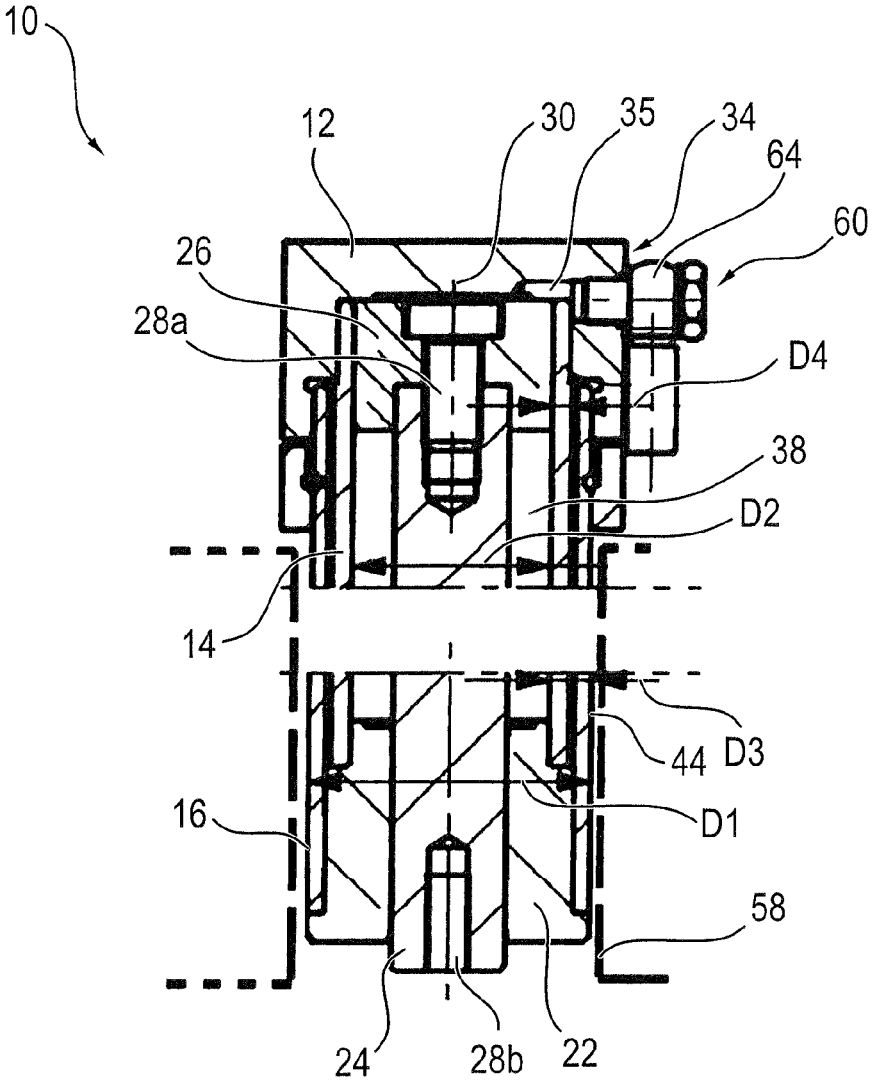
FIG. 7A shows a schematic view in longitudinal section of a double-acting hydraulic cylinder according to an exemplary embodiment.

FIG. 7A shows a schematic longitudinal section of a double-acting hydraulic cylinder 10 according to an exemplary embodiment. In particular, FIG. 7A shows the built-in space 58. In the exemplary embodiment of FIG. 7A, the second connector 34 comprises an exposed hollow screw 60. The exposed hollow screw 60 preferably extends through an annular eyelet 64 up to and into the second through opening 35. As FIG. 7A shows, the exposed hollow screw 60 is arranged on the cylinder bottom 12. In particular, the exposed hollow screw 60 shown in FIG. 7A serves to connect the second connection line 54.

Furthermore, FIG. 7A shows the dimensions D1 to D4. The dimension D1 corresponds to the outside diameter of the second cylinder tube 16, the dimension D2 corresponds to the inside diameter of the first cylinder tube 14, the dimension D3 corresponds to the wall thickness of the first and of the second cylinder tubes 14, 16, and the dimension D4 corresponds to the wall thickness of the first cylinder tube 14. The dimension D1 is preferably 50 mm, the dimension D2 35 mm, the dimension D3 7.5 mm and the dimension D4 3.5 mm.

Figure 7B:
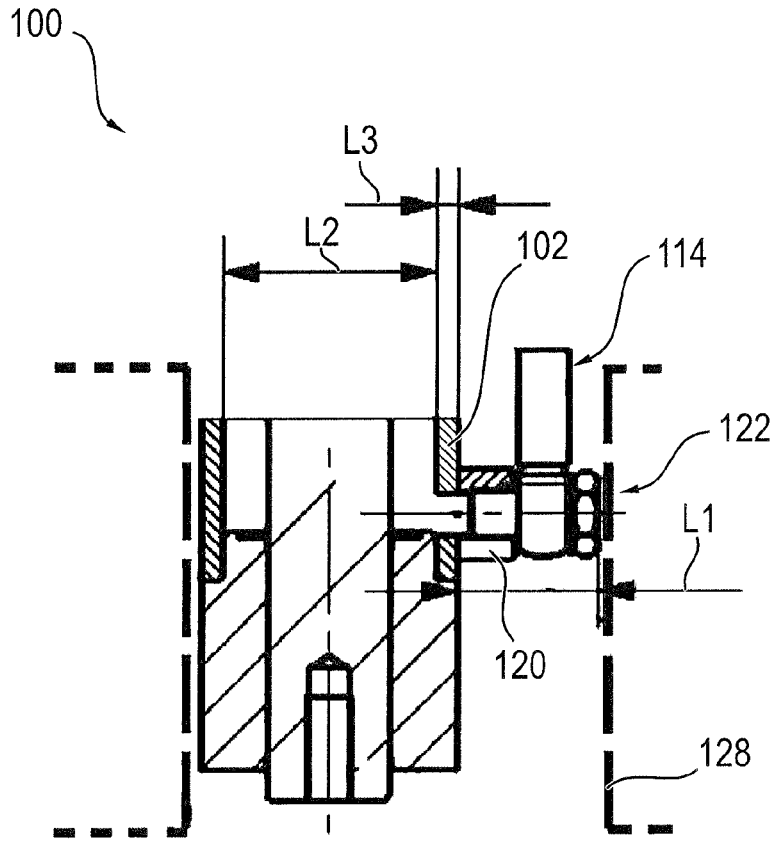
FIG. 7B shows a schematic view in longitudinal section of a double-acting hydraulic cylinder according to the prior art.

FIG. 7B shows a schematic longitudinal view of a double-acting hydraulic cylinder 100 according to the prior art. The built-in space 128 is quite visible in FIG. 7B. Furthermore, the dimensions L1 to L3 are shown in FIG. 7B. The dimension L2 corresponds to the inside diameter of the cylinder tube 102 whereas the dimension L3 corresponds to the wall thickness of the cylinder tube 102. The dimension L1 is may be about (20 mm, the dimension L2 may be about 35 mm and the dimension L3 may be about 3.5 mm.

Regarding FIG. 7A, the sketched, cylindrical built-in space can be maintained at an operating pressure of 70 to 300 bar at a piston diameter and inside diameter D2 of the first cylinder tube 14 of 35 mm according to the present invention by a skillful placing of the second connector 34. The determining outside diameter D1 of the surface area 44 is only 50 mm. This outside diameter D1 is maximally 7.5 mm greater than the piston diameter and/or the inside diameter D2 of the first cylinder tube 14. In the case of different piston diameters and comparable pressure, the measurement of 7.5 mm remains constant.

In contrast to the above, in the prior art shown in FIG. 7B, the connector 114 and/or the exposed hollow screw 122 typically project 23.5 mm above the piston diameter and/or the inside diameter L2 of the cylinder tube 102. Due to the sketched thread depth in a typically used hollow screw M8×1, the known solution cannot be optimized like the solution according to the invention.

Exemplary embodiments of the present invention create a saving of structural space, a reliable feeding of energy inside a double-acting hydraulic cylinder 10 and the bringing of the A and the B connectors 32, 34 close to one another on the cylinder housing 12.

Various embodiments of the present disclosure may have certain advantages, including but not limited to the particular following advantages. The built-in space 58 can be constructed to be distinctly smaller in diameter by the exemplary solutions according to the present disclosure. As a result, structural space in particular may be saved or preserved for other uses. The solution according to the invention relates in particular to double-acting hydraulic cylinders. The double-acting hydraulic cylinder 10 according to embodiments of the present disclosure can be used in particular in operating tables. If in the case of long travel paths of the cylinder 10, the supply unit/control unit 50 of the cylinder 10 is preferably brought to the cinematics of the cylinder bottom 12, the connection lines 52, 54 to the two connectors 32, 34 do not experience any relative movement. If the supply unit/control unit 50 were to be placed on the lot-side unit 56, the hoses would experience a large change in length during the extension of the cylinder 10. The solution of the invention makes it possible to place the B connector 34 also on the cylinder bottom 12. This is not possible in the prior art. Here the connector 114 must be unfavorably placed on the rod-side end via the annular eyelet 120. According to exemplary embodiments, the exposed hollow screw 122 with the threaded sleeve 120 on the surface area of the cylinder tube 102 is eliminated. In particular, damage to the exposed hollow screw 122 by the movements of the cylinder 10 or mounting on the bore 128 can be excluded since the hollow screw 60 is attached in the solution according to various embodiments of the present disclosure on the cylinder bottom 12 outside of the built-in space 58. Furthermore, the supplying of the B side with the hydraulic liquid can be carried out via the double-tube solution of the present disclosure instead of via the lines placed on the outside according to the prior art. Also, the short, flexible lines according to the exemplary embodiments are considerable less susceptible to damage.

Figure 8A:
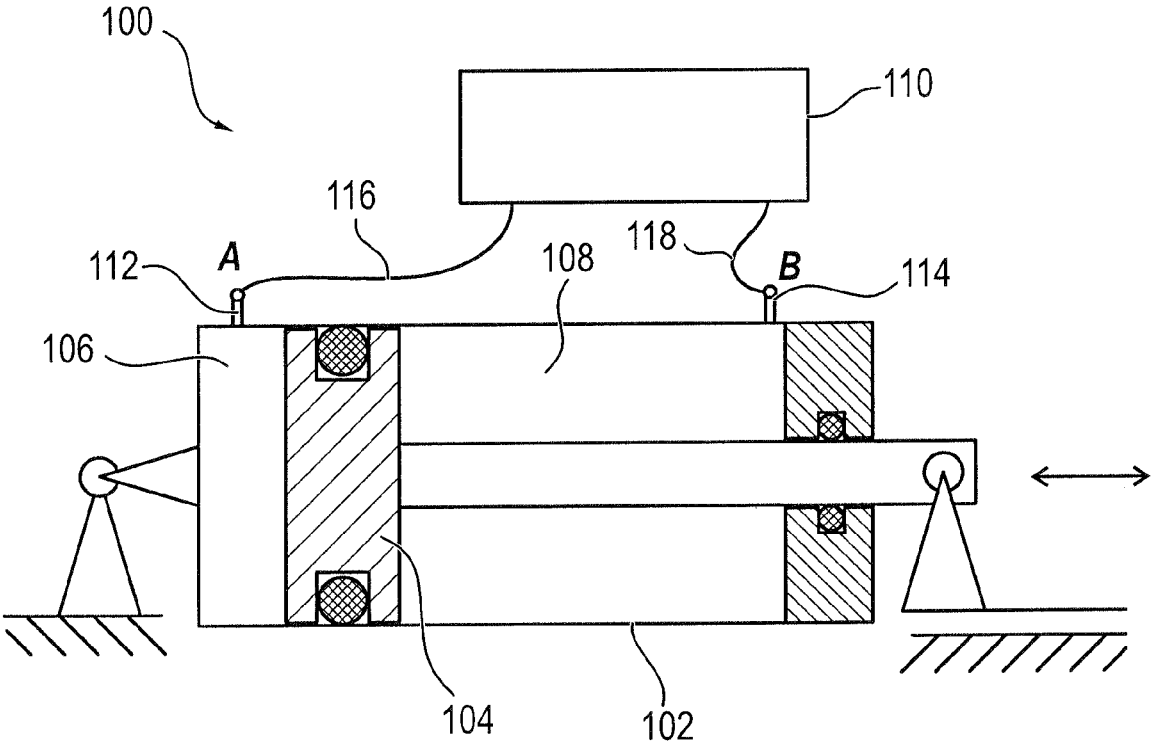
FIG. 8A (PRIOR ART)
FIG. 8A shows an exemplary basic sketch of a double-acting hydraulic cylinder according to the prior art.
Figure 8B:
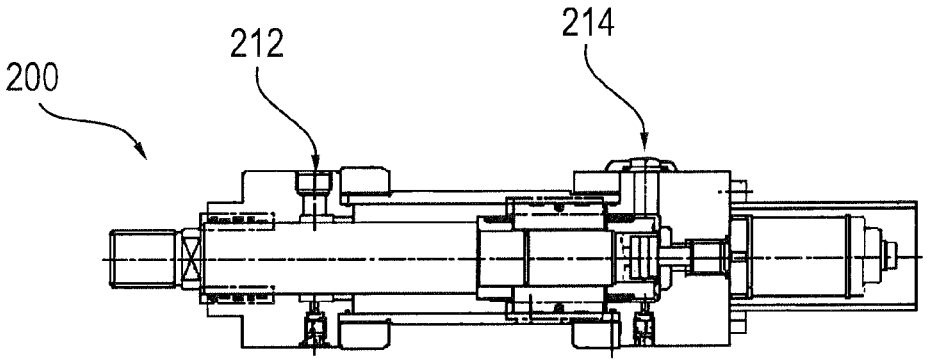
FIG. 8B (PRIOR ART)
FIG. 8B shows a schematic view of a double-acting hydraulic cylinder according to the prior art.
Figure 8C:
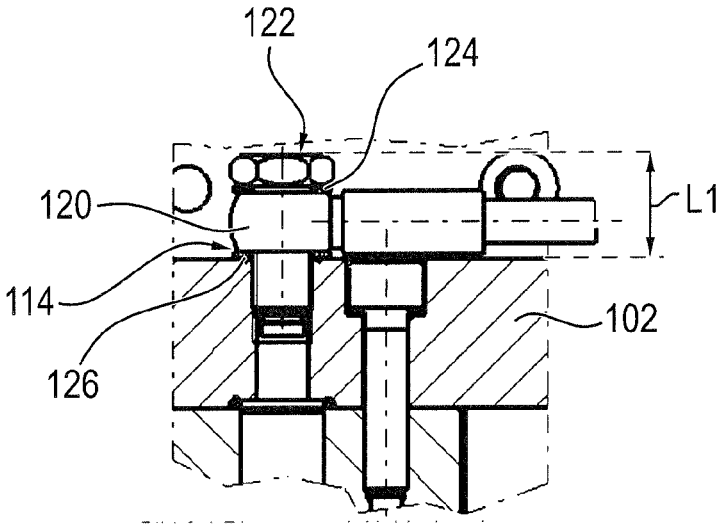
FIG. 8C (PRIOR ART)
FIG. 8C shows a schematic view of an exposed hollow screw of the known, double-acting hydraulic cylinders according to FIG. 8A.

In contrast to known applications with connectors 212, 214 according to FIG. 8B and according to exemplary embodiments, correspondingly much structural space can be freed given the hollow screws.

For applications with little structural space the feeding of the hydraulic liquid, such as, for example an oil feed, can also take place via the piston rod 24, as is shown in the exemplary embodiment of FIG. 5. To this end, for example, two bores 33, 35 can be constructed in the piston rod 24 or several tubes can be pushed into each other in order to obtain two separate, oil-conducting spaces. The A connector 32 and the B connector 35 are arranged on the outer end of the piston rod 24. The exemplary embodiment shown in FIG. 5 has the disadvantage compared to the exemplary embodiment shown in FIG. 1A that the cross section of the piston rod 24 is weakened by the oil bores 33, 35. Furthermore, a long cylinder rod 24 as, e.g., with a ratio of length to diameter of the piston rod greater that 30, is more sensitive to bends due to the weakening attributed to the oil bores 33, 35. Moreover, the bores 33, 35 entail relatively higher expenses when produced by the construction according to FIG. 5 in comparison to the construction according to FIG. 1A.

Instead of the differential cylinder 10 described using FIG. 1A and FIG. 5, the double-acting hydraulic cylinder can also be constructed as a synchronizing cylinder or tandem cylinder.

The foregoing description of the embodiments of the present disclosure has been presented for the purpose of illustration and description only and is not to be construed as limiting the scope of the invention in any way. It is intended that the specification and the disclosed examples be considered as exemplary only, with a true scope being indicated by the following claims.

I claim:

1. A double-acting hydraulic cylinder comprising:

a first cylinder housing and a piston positioned and guided in the first cylinder housing;

a first pressure chamber and a second pressure chamber disposed in the first cylinder housing, the first pressure chamber and the second pressure chamber being separated from one another by the piston;

a first connector configured to feed a hydraulic liquid to the first pressure chamber, and a second connector configured to feed the hydraulic liquid to the second pressure chamber, a second cylinder housing surrounding the first cylinder housing in at least one section, and an annular holding element for holding the second cylinder housing to a cylinder bottom via one or more screws extending through the cylinder bottom;

wherein the first connector and the second connector are arranged on an end of the double-acting hydraulic cylinder facing away from the second pressure chamber;

wherein the second pressure chamber can be loaded with the hydraulic liquid via the section in which the second cylinder housing surrounds the first cylinder housing; and wherein the end of the double-acting hydraulic cylinder facing away from the second pressure chamber comprises the cylinder bottom, and the cylinder bottom surrounds an end of the first cylinder housing facing away from the second pressure chamber and comprises an end of the second cylinder housing facing away from the second pressure chamber.

2. The double-acting hydraulic cylinder of claim 1, wherein the second cylinder housing surrounds the first cylinder housing at least in a section along the longitudinal axis of the double-acting hydraulic cylinder.

3. The double-acting hydraulic cylinder of claim 1, wherein in the first pressure chamber is a piston-side pressure chamber and wherein the second pressure chamber is a piston-rod-side pressure chamber.

4. The double-acting hydraulic cylinder of claim 1, wherein a first sealing element is arranged between the end of the first cylinder housing and the cylinder bottom facing away from the second pressure chamber, and a second sealing element is arranged between the end of the second cylinder housing and the cylinder bottom facing away from the second pressure chamber.

5. The double-acting hydraulic cylinder of claim 4, wherein the second connector comprises a second through opening, and the second through opening extends from a lateral surface of the cylinder bottom to the section in which the second cylinder housing surrounds the first cylinder housing.

6. The double-acting hydraulic cylinder of claim 1, wherein the first connector and the second connector are arranged on the cylinder bottom.

7. The double-acting hydraulic cylinder of claim 6, wherein the first connector comprises a first through opening, and the first through opening extends from a lateral surface of the cylinder bottom to the first pressure chamber.

8. The double-acting hydraulic cylinder according to claim 1, wherein the first cylinder housing and the second cylinder housing are arranged in such a manner that an intermediate space is formed between the first cylinder housing and the second cylinder housing, and wherein the intermediate space extends from the end of the double-acting hydraulic cylinder facing away from the second pressure chamber to an end of the double-acting hydraulic cylinder facing away from the first pressure chamber.

9. The double-acting hydraulic cylinder according to claim 1, wherein the double-acting hydraulic cylinder comprises a rod sleeve, wherein the rod sleeve is arranged on an end of the double-acting hydraulic cylinder facing away from the first pressure chamber, and wherein the rod sleeve is constructed in such a manner that a piston rod connected to the piston is moved upon a loading of the first pressure chamber with the hydraulic liquid in a first direction of piston movement and upon a loading of the second pressure chamber with the hydraulic liquid the piston rod is moved in a second direction of piston movement opposite the first direction of piston movement.

10. The double-acting hydraulic cylinder according to claim 9, wherein the rod sleeve has a groove, and the second pressure chamber can be loaded with the hydraulic liquid via at least one of:

the section in which the second cylinder housing surrounds the first cylinder housing; or the groove of the rod sleeve.

11. The double-acting hydraulic cylinder according to claim 1, wherein the first cylinder housing comprises a first cylinder tube and the second cylinder housing comprises a second cylinder tube.

12. The double-acting hydraulic cylinder of claim 11, wherein the double-acting hydraulic cylinder comprises at least one first holding element for holding the second cylinder housing, wherein the at least one holding element is arranged at least in sections around the second cylinder housing on an outer surface of the second cylinder housing.

13. The double-acting hydraulic cylinder of claim 1, wherein the first connector is constructed in such a manner to be connectable to a first connection line capable of feeding the hydraulic liquid, and the second connector is configured to be connectable to a second connection line capable of feeding hydraulic fluid.

14. A surgical table comprising the double-acting hydraulic cylinder of claim 1.

* * * * *